US009111677B2

(12) United States Patent
Sarver et al.

(10) Patent No.: US 9,111,677 B2
(45) Date of Patent: Aug. 18, 2015

(54) METHOD OF MANUFACTURING A DRY-TYPE OPEN WOUND TRANSFORMER HAVING DISC WINDINGS

(75) Inventors: Charlie Sarver, Rocky Gap, VA (US); William E. Pauley, Jr., Bland, VA (US)

(73) Assignee: ABB Technology AG, Zurich (CH)

( * ) Notice: Subject to any disclaimer, the term of this patent is extended or adjusted under 35 U.S.C. 154(b) by 208 days.

(21) Appl. No.: 13/639,287

(22) PCT Filed: Apr. 4, 2011

(86) PCT No.: PCT/US2011/031122

§ 371 (c)(1), (2), (4) Date: Oct. 4, 2012

(87) PCT Pub. No.: WO2011/126994

PCT Pub. Date: Oct. 13, 2011

(65) Prior Publication Data

US 2013/0021127 A1 Jan. 24, 2013

Related U.S. Application Data

(60) Provisional application No. 61/321,860, filed on Apr. 7, 2010.

(51) Int. Cl.

| | |
|---|---|
| ***H01F 7/06*** | (2006.01) |
| ***H01F 27/28*** | (2006.01) |
| ***H01F 27/32*** | (2006.01) |
| ***H01F 41/06*** | (2006.01) |

(52) U.S. Cl.

CPC ..... *H01F 27/28* (2013.01); *H01F 27/322* (2013.01); *H01F 27/327* (2013.01); *H01F 41/0637* (2013.01); *Y10T 29/49071* (2015.01)

(58) Field of Classification Search

USPC ..... 29/602.1, 604, 606, 607, 868; 242/610.6; 336/110, 175, 178, 184, 336/186, 206, 213–215, 220, 234

See application file for complete search history.

(56) References Cited

U.S. PATENT DOCUMENTS

| | | | | |
|---|---|---|---|---|
| 3,170,225 | A | 2/1965 | Gray et al. | |
| 3,737,990 | A * | 6/1973 | Schut | 29/605 |
| 4,000,482 | A | 12/1976 | Staub et al. | |
| 4,311,979 | A * | 1/1982 | Graul | 336/205 |
| 4,321,426 | A * | 3/1982 | Schaeffer et al. | 174/34 |
| 4,521,955 | A * | 6/1985 | Closson et al. | 29/605 |
| 4,629,918 | A * | 12/1986 | Amendola et al. | 310/65 |
| 5,167,063 | A | 12/1992 | Hulsink | |
| 5,296,829 | A | 3/1994 | Kothmann et al. | |
| 6,160,464 | A | 12/2000 | Clarke et al. | |
| 6,930,579 | B2 * | 8/2005 | Radford et al. | 336/90 |

(Continued)

FOREIGN PATENT DOCUMENTS

| | | |
|---|---|---|
| DE | 10337153 A1 | 3/2005 |
| EP | 0370574 A1 | 5/1990 |
| GB | 587997 | 5/1947 |
| GB | 819038 | 8/1959 |
| GB | 854564 A | 11/1960 |
| GB | 909516 | 10/1962 |

(Continued)

*Primary Examiner* — Paul D Kim

(74) *Attorney, Agent, or Firm* — Paul R. Katterle; Melissa J. Szczepanik

(57) ABSTRACT

Method of manufacturing a dry-type open wound transformer having disc windings is provided. The transformer has one or more high voltage windings, each of which includes a plurality serially connected discs. Each disc has two or more sections, wherein the sections are separated from each other by spaces arranged in a circumferential configuration.

16 Claims, 7 Drawing Sheets

(56) References Cited

U.S. PATENT DOCUMENTS

| | | | | |
|---|---|---|---|---|
| 7,788,794 | B2 * | 9/2010 | Sarver et al. | 29/602.1 |
| 2007/0279177 | A1 | 12/2007 | Sarver et al. | |

FOREIGN PATENT DOCUMENTS

| | | | |
|---|---|---|---|
| JP | 10300410 | A * | 11/1998 |
| WO | 2011126994 | A1 | 10/2011 |

* cited by examiner

METHOD OF MANUFACTURING A DRY-TYPE OPEN WOUND TRANSFORMER HAVING DISC WINDINGS

BACKGROUND OF THE INVENTION

This invention relates to transformers and more particularly to open wound transformers having disc windings.

As is well known, a transformer converts electricity at one voltage to electricity as another voltage, either of higher or lower value. A transformer achieves this voltage conversion using a primary coil and a secondary coil, each of which is wound on a ferromagnetic core and comprise a number of turns of an electrical conductor. The primary coil is connected to a source of voltage and the secondary coil is connected to a load. The ratio of turns in the primary coil to the turns in the secondary coil ("turns ratio") is the same as the ratio of the voltage of the source to the voltage of the load. Two main winding techniques are used to form coils, namely layer winding and disc winding. The type of winding technique that is utilized to form a coil is primarily determined by the number of turns in the coil and the current in the coil. For high voltage windings with a large number of required turns, the disc winding technique is typically used, whereas for low voltage windings with a smaller number of required turns, the layer winding technique is typically used.

In the disc winding technique, the conductor turns required for a coil are wound in a plurality of discs serially disposed along the axial length of the coil. In each disc, the turns are wound in a radial direction, one on top of the other, i.e., one turn per layer. The discs are connected in a series circuit relation and are typically wound alternately from inside to outside and from outside to inside so that the discs can be formed from the same conductor. An example of such alternate winding is shown in U.S. Pat. No. 5,167,063.

A transformer with disc windings may be cooled by a liquid dielectric or may be dry, i.e., cooled by air as opposed to a liquid dielectric. One type of dry transformer is a so-called open wound transformer, wherein the windings are coated, impregnated or encapsulated with a varnish such as by dipping or using a vacuum and pressure application process.

The present invention is directed to improvements in an open wound transformer having disc windings.

SUMMARY OF THE INVENTION

The present invention is directed to a method of manufacturing a dry power distribution transformer. In accordance with the method, a winding is formed over a mandrel and is then mounted to a ferromagnetic core. The winding includes a plurality of serially connected discs arranged in an axial direction of the winding. The forming of the winding includes forming each disc by winding a conductor and an insulating strip around the mandrel to form a radially-inner section of the disc that has a plurality of concentric and alternating layers of the insulating strip and the conductor. Each pair of adjacent layers in the radially-inner section are in contact with each other. A plurality of spacers are disposed around the circumference of the radially-inner section. The conductor and the insulating strip are wound around the spacers to form a radially-outer section of the disc that has a plurality of concentric and alternating layers of the insulating strip and the conductor. Each pair of adjacent layers in the radially-outer section are in contact with each other. The radially-outer section is separated from the radially-inner section by a plurality of spaces arranged in a circumferential configuration.

Also provided in accordance with the present invention is a power distribution transformer having a ferromagnetic core and a winding mounted to the ferromagnetic core. The winding has a plurality of serially connected discs arranged in an axial direction of the winding. Each disc includes a radially-inner section that has a plurality of concentric and alternating layers of an insulating strip and a conductor. Each pair of adjacent layers in the radially-inner section are in contact with each other. A plurality of spacers are disposed around the circumference of the radially-inner section. A radially-outer section is disposed around the spacers and is connected to the radially-inner section. The radially-outer section includes a plurality of concentric and alternating layers of the insulating strip and the conductor. Each pair of adjacent layers in the radially-outer section are in contact with each other. The radially-outer section is separated from the radially-inner section by a plurality of spaces arranged in a circumferential configuration.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
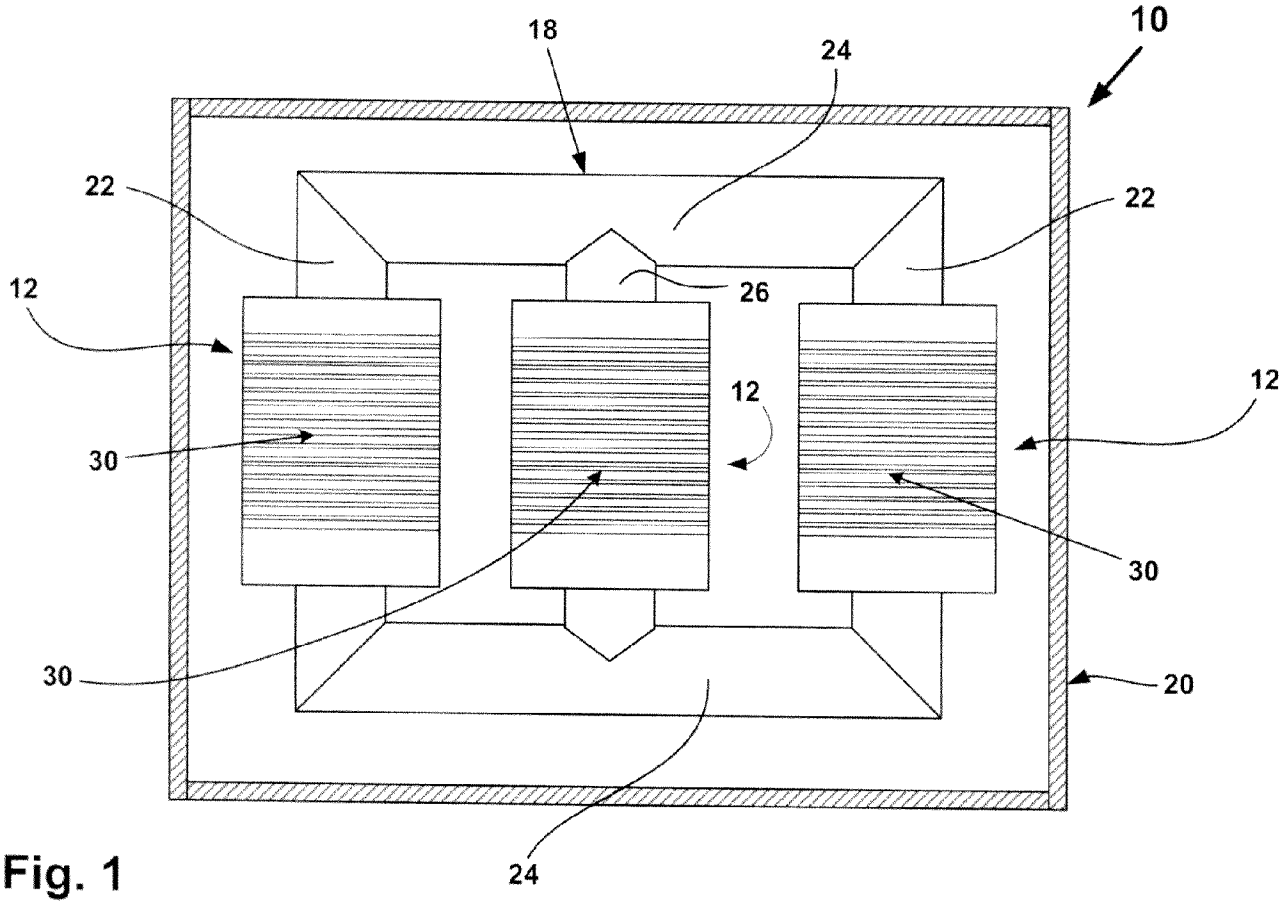
FIG. 1 is a schematic sectional view of a transformer embodied in accordance with the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown an interior view of a three phase transformer 10 containing a coil embodied in accordance with the present invention. The transformer 10 comprises three winding assemblies 12 (one for each phase)

mounted to a core 18 and enclosed within a ventilated outer housing 20. The core 18 is comprised of ferromagnetic metal and is generally rectangular in shape. The core 18 includes a pair of outer legs 22 extending between a pair of yokes 24. An inner leg 26 also extends between the yokes 24 and is disposed between and is substantially evenly spaced from the outer legs 22. The winding assemblies 12 are mounted to and disposed around the outer legs 22 and the inner leg 26, respectively. Each winding assembly 12 comprises a low voltage winding 28 (shown in FIG. 2) and a high voltage winding 30, each of which is cylindrical in shape. If the transformer 10 is a step-down transformer, the high voltage winding 30 is the primary winding and the low voltage winding 28 is the secondary winding. Alternately, if the transformer 10 is a step-up transformer, the high voltage winding 30 is the secondary winding and the low voltage winding 28 is the high voltage winding. In each winding assembly 12, the high voltage winding 30 and the low voltage winding 28 may be mounted concentrically, with the low voltage winding 28 being disposed within and radially inward from the high voltage winding 30, as shown in FIG. 1. Alternately, the high voltage winding 30 and the low voltage winding 28 may be mounted so as to be axially separated, with the low voltage winding 28 being mounted above or below the high voltage winding 30.

The transformer 10 may be a distribution transformer having a kVA rating in a range of from about 112.5 kVA to about 15,000 kVA. The voltage of the high voltage windings may be in a range of from about 600 V to about 35 kV and the voltage of the low voltage windings 28 may be in a range of from about 120 V to about 15 kV.

Although the transformer 10 is shown and described as being a three phase distribution transformer, it should be appreciated that the present invention is not limited to three phase transformers or distribution transformers. The present invention may utilized in single phase transformers and transformers other than distribution transformers.

Figure 2:
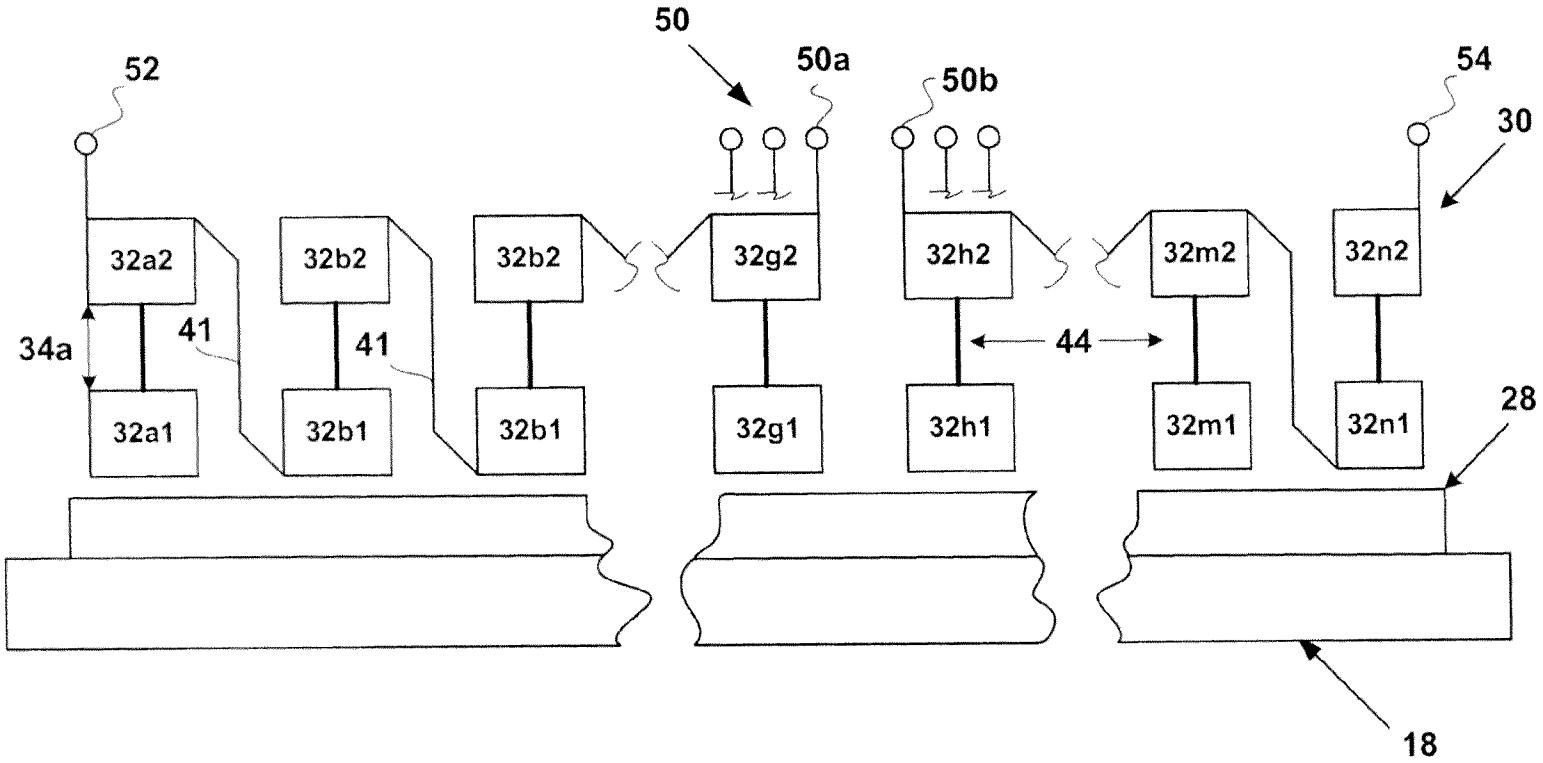
FIG. 2 is a schematic sectional side view of a portion of the transformer showing the wiring of discs of a high voltage winding.

FIG. 2 shows a schematic of a portion of the transformer 10 of the present invention. Each high voltage winding 30 comprises a plurality of serially connected discs 32. Each disc 32 comprises two or more sections arranged concentrically, with each pair of adjacent sections being separated by a plurality of circumferential spaces or gaps, i.e., gaps arranged in a ring or circle. For example, each disc 32 is shown in FIG. 2 as having two sections separated by circumferential gaps 34. Thus, disc 32*a* has sections 32*a*-1 and 32*a*-2 that are separated by circumferential gaps 34*a*, with the section 32*a*-1 being disposed radially inward from the section 32*a*-2.

Each disc 32 comprises a plurality of concentric layers of a conductor 40. The conductor 40 is composed of a metal such as copper or aluminum and may be in the form of a wire with an elliptical or rectangular cross-section. Alternately, the conductor 40 may be in the form of a foil, wherein the conductor 40 is thin and rectangular, with a width as wide as the disc 32 it forms. In the embodiments shown and described, it has been found particularly useful to use foil conductors, more specifically foil conductors having a width to thickness ratio of greater than 20:1, more particularly from about 250:1 to about 25:1, more particularly from about 200:1 to about 50:1, still more particularly about 150:1. In one particular embodiment, the foil conductor is between about 0.008 to about 0.02 inches thick and between about 1 and 2 inches wide, more particularly about 0.01 inches thick and about 1.5 inches wide. In each disc 32, the turns of the conductor 40 are wound in a radial direction, one on top of the other, i.e., one turn per layer. A layer of insulating material 42 (shown in FIG. 3) is disposed between each layer or turn of the conductor 40. In this manner, there are alternating layers of the conductor 40 and the insulating material 42. The insulating material 42 may be comprised of a polyimide film, such as is sold under the trademark Nomex®; a polyamide film, such as is sold under the trademark Kapton®; or a polyester film, such as is sold under the trademark Mylar®.

In each section of a disc 32, the layers of the conductor 40 and the insulating material 42 are tightly wound so that there are no gaps between any two adjacent layers, i.e., in each pair of adjacent layers, the layers are in contact with each other. In addition, the radially-inner sections of the discs 32 have the same number of layers so that the radially-inner sections have substantially the same radius. The radially-outer sections of the discs 32 may also have the same number of layers so that the radially-outer sections have substantially the same radius. The circumferential gaps 34 in the discs 32 have substantially the same width and are aligned from disc to disc. With the discs 32 being constructed as described above, the aligned circumferential gaps 34 form cooling passages 44 that extend axially through all of the discs 32.

In each pair of adjacent sections of a disc 32, the sections are connected together by a portion of the conductor 40 that extends through a gap 34 between the two sections, as shown in FIG. 2. All of the sections of each disc 32 may be formed from one continuous length of the conductor 40. Alternately, the sections may be formed from separate lengths of the conductor 40, respectively, with each section being formed from one length of the conductor 40 and the different lengths of the conductor 40 being secured together, such as by welding.

In forming the series of discs 32, the conductor 40 can be continuously wound from disc 32 to disc 32 or may be provided with "drop-downs" 41 between discs 32 (as shown in FIG. 2). If the conductor 40 is continuously wound, the conductor 40 is wound from disc 32 to disc 32 in alternating directions, i.e., inside to outside and then outside to inside, etc. If the conductor 40 is provided with drop-downs 41 between discs 32, the conductor 40 is wound in one direction, i.e., inside to outside. A drop-down 41 is a bend that is formed at the completion of a disc 32 to bring the conductor 40 from the outermost section back to the inside to begin a subsequent disc 32. If the thickness of the conductor 40 permits drop-downs 41 to be formed without too much difficulty, the use of drop-downs is preferred.

The discs 32 may be connected together in the manner shown in FIG. 2. As shown, the discs 32 may be arranged in two groups, with the discs 32 in each group being serially connected together. The two groups may be connected together using nominal taps 50 that are connected to different discs 32, respectively. Main taps 52, 54 are connected to the discs 32*a*, 32*n*, respectively. Connecting together different pairs of the nominal taps 50 changes the turns ratio of the transformer 10. For example, connecting together the nominal taps 50*a* and 50*b* serially connects together all of the discs 32. The main taps 50, 52 are located toward ends of the high voltage winding 30, respectively, while the nominal taps are located toward the center of the high voltage winding 30.

Figure 4:
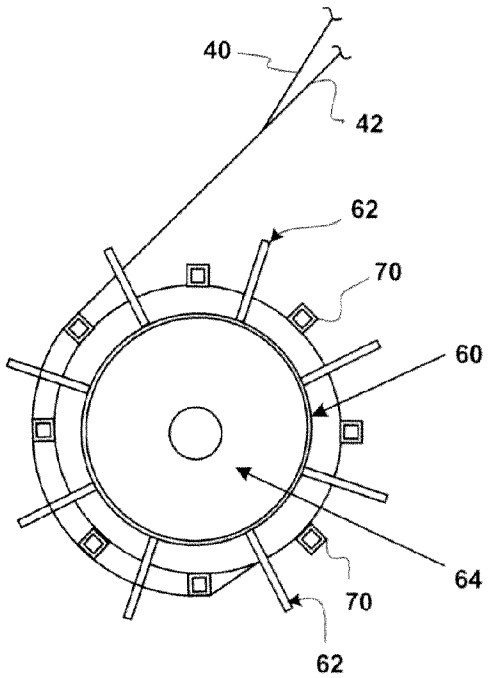
FIG. 4 is a schematic end view of the high voltage winding being formed, wherein a radially-outer section of the disc is being formed over the layer of the spacers.
Figure 3:
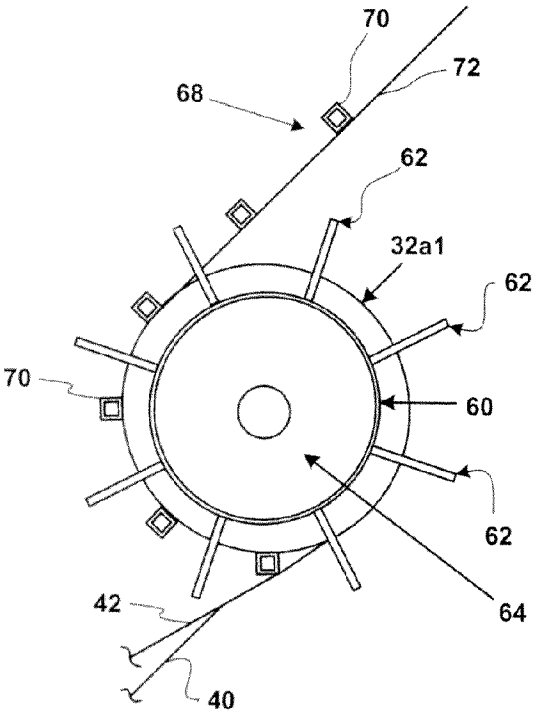
FIG. 3 is a schematic end view of the high voltage winding being formed, wherein a layer of spacers is being formed over a radially-inner section of one of the discs.
Figure 5:
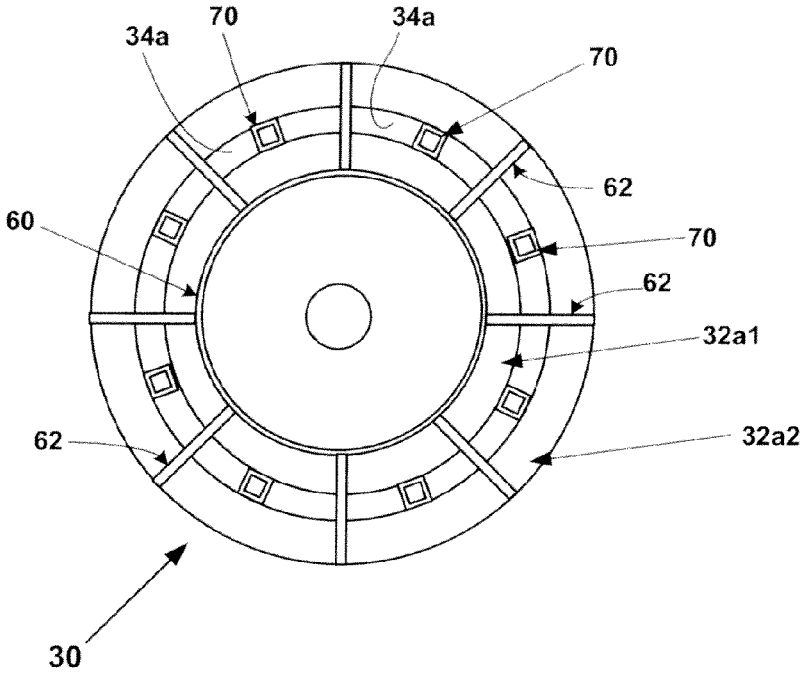
FIG. 5 is an end view of the completed high voltage winding with the spacers.
Figure 6:
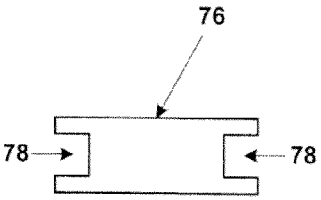
FIG. 6 shows a top plan view of a spacer insert.
Figure 8:
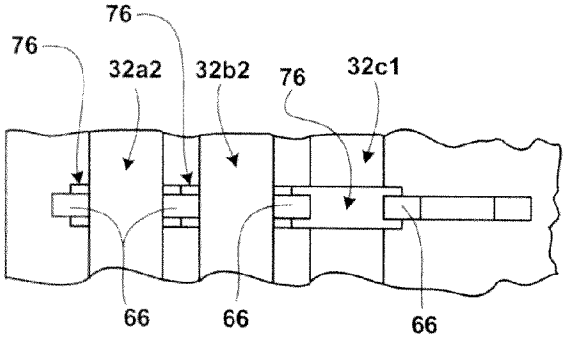
FIG. 8 shows a schematic top plan view of a portion of the high voltage winding being formed using the spacer inserts.
Figure 7:
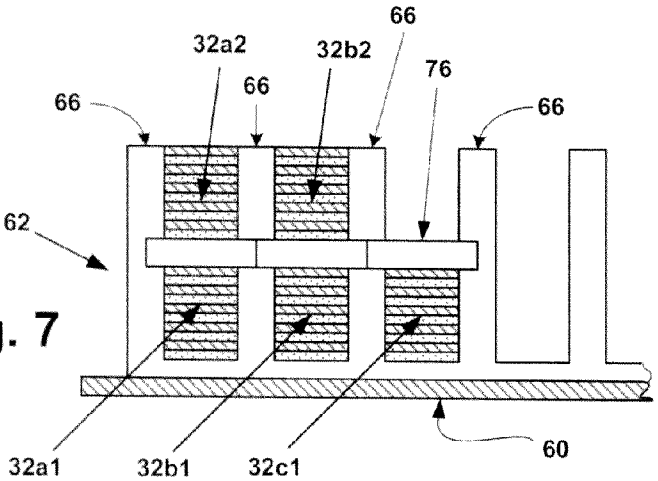
FIG. 7 shows a schematic sectional side view of a portion of a high voltage winding being formed using spacer inserts, each of which is disposed between teeth of a comb structure.
Figure 9:
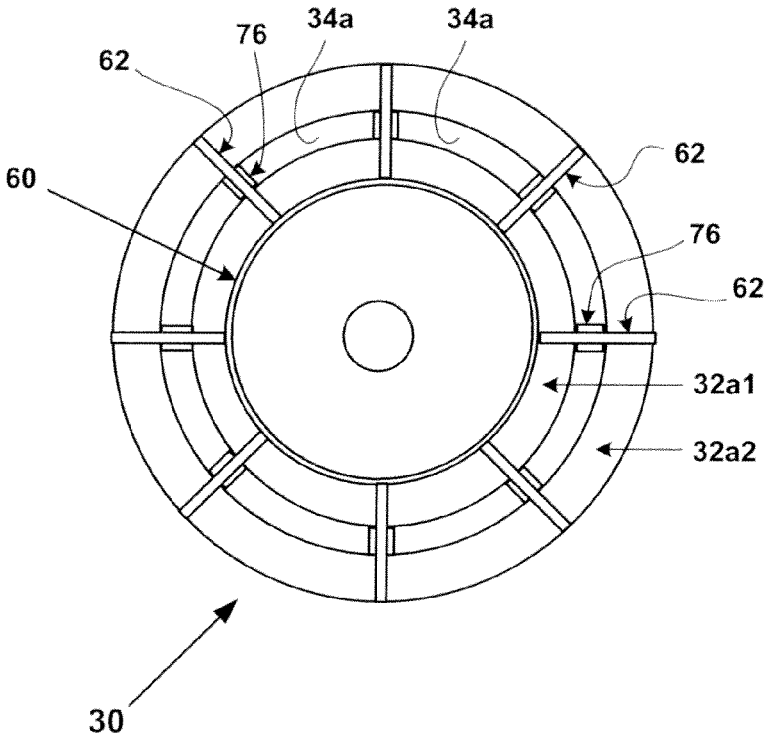
FIG. 9 is an end view of the completed high voltage winding with the spacer inserts.

The radially-inner sections of the discs 32 may be formed on a cylindrical high/low insulation barrier 60 having comb structures 62, as shown in FIGS. 3-5. The comb structures 62 may be integrally formed with the insulation barrier 60, or may be secured to the insulation barrier 60, such as by tape, adhesive or other fastening means. The comb structures 62 are disposed around the circumference of the insulation barrier 60 in a spaced-apart manner. The comb structures 62 extend lengthwise in an axial direction of the insulation barrier 60 and project radially outward. The insulation barrier 60 is composed of an insulating material, such as a non-conductive dielectric plastic, and is sized to fit over the low voltage winding 28. The insulation barrier 60 is mounted on a mandrel 64 that is rotated manually or mechanically, such as by an electric motor. The mandrel 64, with the insulation barrier 60 mounted thereto, is located adjacent to a supply of the conductor 40 and a supply of the insulating material 42. As the mandrel 64 rotates, the insulating material 42 and the conductor 40 are wrapped around the insulation barrier 60 to form a radially-inner section of a disc 32 comprising a plurality of concentric turns or layers of the conductor 40 interleaved with a plurality of concentric turns or layers of the insulating material 42. If comb structures 62 are provided, the conductor 40 and the insulating material 42 are wound through a circumferentially-arranged series of notches or gaps formed by teeth 66 of the comb structures 62, wherein each gap is formed between a pair of adjacent teeth 66 in a comb structure 62.

After the last turn or layer of the conductor 40 is wound over the insulation barrier 60 to form the radially-inner section, a layer of spacers 70 are formed around the circumference of the radially-inner section. The layer of spacers 70 may be formed using a spacer tape 68 that comprises a plurality of the spacers 70, arranged in a spaced-apart manner and secured to a piece of insulating tape 72, which may be comprised of an insulating material, such as polyimide, polyamide, or polyester. The spacers 70 may be attached to the tape 72 before the tape is secured over the radially-inner section (as shown) or afterwards. Each spacer 70 is hollow, has a rectangular cross-section and may be composed of a fiber reinforced plastic in which fibers, such as fiberglass fibers, are impregnated with a thermoset resin, such as a polyester resin, a vinyl ester resin, or an epoxy resin. The spacers 70 are secured to the tape 72 by an adhesive and extend longitudinally along the width of the tape 72. In the embodiment where the conductor 40 forming the discs 32 is comprised of foil, the lengths of the spacers 70 and the width of the tape 72 are about the same as the width of the conductor 40. The spacer tape 68 is wrapped onto the radially-inner section of the disc winding 36 to form a single turn such that the tape 72 adjoins the radially-inner section and the spacers 70 extend radially outward like spokes. Ends of each piece of spacer tape 68 may be fastened together (such as by adhesive tape) to form a loop that is disposed radially outward from the radially-inner section of the disc 32. The loop may be secured to the radially-inner section of the disc 32.

As indicated above, a loop of the tape 72 may first be secured over the radially-inner section of the disc 32 and thereafter the spacers 72 may be attached to the tape 72 by adhesive, tape or other securing means.

The number of spacers 70 that are used may be the same as the number of comb structures 62. If so, the spacers 70 may be aligned with the comb structures 62 so as to be disposed between pairs of teeth 66, respectively, or the spacers 70 may be disposed between the comb structures 62 so as to not be disposed between pairs of teeth 66 (as shown in FIGS. 3-5). The number of spacers 70 may also be greater than the number of comb structures 62. If so, the spacers 70 may be aligned with the comb structures 62 so as to be disposed between pairs of teeth 66, respectively, and may also be disposed between the comb structures 62.

After the layer of spacers 70 has been formed, the radially-outer section of the disc 32 is formed over the layer of spacers 70 so as to be supported on the spacers 70 and spaced from the radially-inner section of the disc 32. An initial layer of the insulating material 42 directly contacts the spacers 70. Thereafter, alternating layers of the conductor 40 and the insulating material 70 are wound over the initial layer to form the radially-outer section of the disc 32. When the radially-outer section of the disc 32 is complete, the next disc 32 may be wound from the same piece of conductor 40 and the same piece of insulating material 42 in the same manner as described above. This process is continued until all of the discs 32 in the high voltage winding 30 are formed. In this manner, all of the discs 32 in the high voltage winding 30 may be formed from one continuous piece of the conductor 40 and one continuous piece of the insulating material 42.

Once the winding of the discs 32 is complete, each disc 32 comprises a radially-inner section (e.g. section **32*a*1) electrically connected to a radially-outer section (e.g. section 32*a*2), wherein the radially-inner section and the radially-outer section are concentrically arranged, axially aligned and radially separated by circumferential gaps 34 (e.g. gaps 34*a*). The gaps 34 are circumferentially separated by the spacers 70**.

The circumferential gaps 34 may be formed using methods and devices other than the spacers 70. For example, spacer inserts 76 may be used to form the circumferential gaps 34. Referring now to FIGS. 6-9, the spacer inserts 76 are each rectangular in shape with notches 78 formed in opposing ends thereof, respectively. Each spacer insert 76 is composed of an insulating material, such as a non-conductive dielectric plastic.

A disc 32 is formed by first winding the conductor 40 and the insulating material 42 through a circumferentially-arranged series of gaps formed by teeth 66 of the comb structures 62 so as to form a radially-inner section of the disc 32. After the radially-inner section of a disc 32 is formed, a spacer insert 76 is installed in each comb structure 62 so as to extend across the gap in the teeth 66 of the comb structure 62 through which the radially-inner section extends. Each spacer insert 76 is installed such that portions of the teeth 66 forming the gap extend through the notches in the spacer insert 76, respectively, and the spacer insert 76 rests against the radially-inner section. In this manner, the spacer inserts 76 extend across the width of the radially-inner section of the disc 32 and are secured from axial and lateral movement. With the spacer inserts 76 so installed, the radially-outer section of the disc 32 is then formed over the spacer inserts 76 so as to be supported on the spacer inserts 76 and spaced from the radially-inner section of the disc 32. Subsequent discs 32 are then formed in the same manner. As with the use of the spacers 70, all of the discs 32 may be formed from a single piece of the conductor 40.

Figure 11:
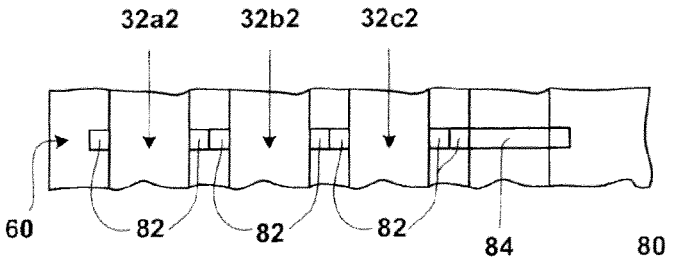
FIG. 11 shows a schematic top plan view of a portion of the high voltage winding being formed using the spacer supports.
Figure 10:
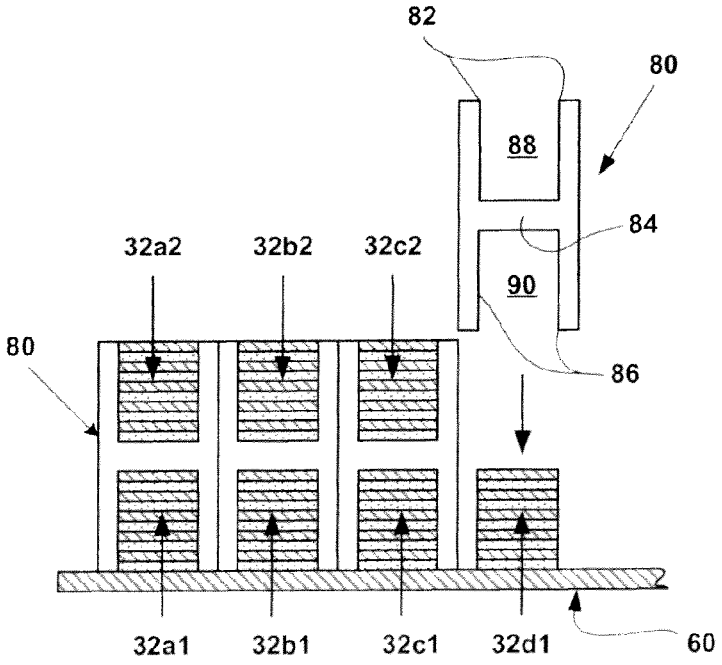
FIG. 10 shows a schematic sectional side view of a portion of a high voltage winding being formed using spacer supports.

The circumferential gaps 34 may also be formed using spacer supports 80. When the spacer supports 80 are used, the comb structures 62 are not utilized. Referring now to FIGS. 10-11, each spacer support 80 is H-shaped and is composed of an insulating material, such as a non-conductive dielectric plastic. The spacer supports 80 each comprise a pair of spaced-apart top posts 82 integrally joined by a center bar 84 to a pair of spaced-apart bottom posts 86. The top posts 82 and the center bar 84 form a top groove or channel 88 and the bottom posts 86 and the center bar 84 form a bottom groove or channel 90.

A disc 32 is formed by first winding the conductor 40 and the insulating material 42 over the insulation barrier 60 so as to form a radially-inner section of the disc 32. Once the radially-inner section is complete, a plurality of spacer supports 80 are disposed around the circumference of the radially-inner section so that the radially-inner section extends through the bottom channels 90 of the spacer supports 80. With the spacer inserts 76 so installed, the radially-outer section of the disc 32 is then formed by winding the conductor 40 and the insulating material 42 through the top channels 88 and over the center bar 84 of the spacer inserts 76. In this manner, the radially-outer section of the disc 32 is supported on the center bars 84 of the spacer inserts 76 and is spaced from the radially-inner section of the disc 32. Subsequent discs 32 are then formed in the same manner. As with the use of the spacers 70 and the spacer inserts 76, all of the discs 32 may be formed from a single piece of the conductor 40.

Once a high voltage winding 30 has been fully wound, the high voltage winding 30 is removed from the winding mandrel 64 and then coated, impregnated or encapsulated with an insulating varnish, such as by dipping or using a vacuum and pressure application process. The insulating varnish comprises a resin, such as an epoxy resin or a polyester resin.

In one embodiment, the high voltage winding 30 is heated in an oven to remove moisture from the insulating layers and the conductor layers and then placed in a vacuum chamber. The vacuum chamber is evacuated to remove any remaining moisture and gases in the high voltage winding 30 and to eliminate any voids between adjacent turns in the discs 32. The insulating varnish is then applied to the high voltage winding 30, while the vacuum is maintained. The vacuum is held for a predetermined time interval to allow the insulating varnish to impregnate the discs 32. The vacuum is then released. Pressure may then be applied to the high voltage winding 30 to force the insulating varnish to impregnate any remaining voids. Heat may subsequently be applied to high voltage coil 30, such as in an oven, to dry/cure the varnish.

The high voltage winding 30 coated/impregnated/encapsulated with the insulating varnish is then mounted to the core 18, over the low voltage winding 28.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A method of manufacturing a dry, open wound power distribution transformer comprising:

(a.) providing a ferromagnetic core;

(b.) providing a cylindrical insulation barrier having a plurality of circumferentially spaced and radially-extending comb structures, each comb structure comprising a plurality of teeth, wherein the teeth of the comb structures form a series of gap rings arranged along an axial length of the insulation barrier, each of the gap rings comprising a series of circumferentially arranged gaps;

(c.) forming a winding over the insulation barrier, the winding comprising a plurality of serially connected discs arranged in an axial direction of the winding, wherein the forming of the winding comprises forming each disc by:

winding a conductor and an insulating strip around the insulation barrier, inside one of the gap rings, to form a radially-inner section of the disc comprising a plurality of concentric and alternating layers of the insulating strip and the conductor, wherein each pair of adjacent layers in the radially-inner section are in contact with each other;

disposing a plurality of spacers around the circumference of the radially-inner section; and winding the conductor and the insulating strip around the spacers to form a radially-outer section of the disc comprising a plurality of concentric and alternating layers of the insulating strip and the conductor, wherein each pair of adjacent layers in the radially-outer section are in contact with each other, and wherein the radially-outer section is separated from the radially-inner section by a plurality of spaces arranged in a circumferential configuration;

d.) applying an insulating varnish to the winding; and e.) mounting the winding to the ferromagnetic core.

2. The method of claim 1, wherein the forming of the winding is performed such that the spaces in the discs between the radially-inner and radially-outer sections are aligned from disc to disc so as to form a plurality of cooling channels that axially extend through all of the discs.

3. The method of claim 2, wherein the winding of the conductor and the insulating strip to form the radially-inner section of each of the discs is performed so that the radially-inner sections of the discs have the same number of layers.

4. The method of claim 1, wherein each spacer extends between a pair of the teeth.

5. The method of claim 4, wherein each spacer comprises a body having opposing ends with notches formed therein, respectively, and wherein for each spacer disposed between a pair of the teeth, portions of the teeth are disposed in the notches of the spacer, respectively.

6. The method of claim 1, wherein the spacers are located between the comb structures.

7. The method of claim 6, wherein each spacer is hollow and has a rectangular cross-section.

8. The method of claim 1, wherein the step of disposing the spacers around the circumference of the radially-inner section of each the discs comprises providing a piece of tape having a plurality of the spacers secured thereto in a spaced-apart manner and winding the piece of tape around the circumference of the radially-inner section.

9. The method of claim 1, wherein the conductor is a foil conductor having a width to thickness ratio of greater than 20:1.

10. The method of claim 1, wherein the transformer is a three phase transformer and the winding is a first winding, and wherein the method further comprises forming second and third windings and mounting the second and third windings to the ferromagnetic core.

11. The method of claim 10, further comprising enclosing the first, second and third windings in a ventilated outer housing.

12. The method of claim 1, wherein the winding is a high voltage winding and wherein the method further comprises disposing the high voltage winding over a low voltage winding so that the low voltage winding is disposed within and radially inward from the high voltage winding.

13. A method of manufacturing a dry, open wound power distribution transformer comprising:

(a.) providing a ferromagnetic core;

(b.) providing a cylindrical insulation barrier having a plurality of circumferentially spaced and radially-extending comb structures, each comb structure comprising a plurality of teeth, wherein the teeth of the comb structures form a series of gap rings arranged along an axial length of the insulation barrier, each of the gap rings comprising a series of circumferentially arranged gaps;

(c.) forming a winding over the insulation barrier, the winding comprising a plurality of serially connected discs arranged in an axial direction of the winding, wherein the forming of the winding comprises forming each disc by:

winding a conductor and an insulating strip around the insulation barrier, inside one of the gap rings, to form a radially-inner section of the disc comprising a plurality of concentric and alternating layers of the insulating strip and the conductor, wherein each pair of adjacent layers in the radially-inner section are in contact with each other;

disposing a plurality of spacers around the circumference of the radially-inner section and wherein each spacer extends between a pair of the teeth; and winding the conductor and the insulating strip around the spacers to form a radially-outer section of the disc comprising a plurality of concentric and alternating layers of the insulating strip and the conductor, wherein each pair of adjacent layers in the radially-outer section are in contact with each other, and wherein the radially-outer section is separated from the radially-inner section by a plurality of spaces arranged in a circumferential configuration;

d.) applying an insulating varnish to the winding; and e.) mounting the winding to the ferromagnetic core.

14. The method of claim 13, wherein each spacer comprises a body having opposing ends with notches formed therein, respectively, and wherein for each spacer disposed between a pair of the teeth, portions of the teeth are disposed in the notches of the spacer, respectively.

15. A method of manufacturing a dry, open wound power distribution transformer comprising:

(a.) providing a ferromagnetic core;

(b.) providing a cylindrical insulation barrier having a plurality of circumferentially spaced and radially-extending comb structures, each comb structure comprising a plurality of teeth, wherein the teeth of the comb structures form a series of gap rings arranged along an axial length of the insulation barrier, each of the gap rings comprising a series of circumferentially arranged gaps;

(c.) forming a winding over the insulation barrier, the winding comprising a plurality of serially connected discs arranged in an axial direction of the winding, wherein the forming of the winding comprises forming each disc by:

winding a conductor and an insulating strip around the insulation barrier, inside one of the gap rings, to form a radially-inner section of the disc comprising a plurality of concentric and alternating layers of the insulating strip and the conductor, wherein each pair of adjacent layers in the radially-inner section are in contact with each other;

disposing a plurality of spacers around the circumference of the radially-inner section and wherein the spacers are located between the comb structures; and winding the conductor and the insulating strip around the spacers to form a radially-outer section of the disc comprising a plurality of concentric and alternating layers of the insulating strip and the conductor, wherein each pair of adjacent layers in the radially-outer section are in contact with each other, and wherein the radially-outer section is separated from the radially-inner section by a plurality of spaces arranged in a circumferential configuration;

d.) applying an insulating varnish to the winding; and e.) mounting the winding to the ferromagnetic core.

16. The method of claim 15 wherein each spacer is hollow and has a rectangular cross-section.

* * * * *